US009331434B2

(12) United States Patent
Zhu et al.

(10) Patent No.: US 9,331,434 B2
(45) Date of Patent: May 3, 2016

(54) ELECTRICAL CONNECTOR WITH ENHANCED STRUCTURE

(71) Applicant: HON HAI PRECISION INDUSTRY CO., LTD., New Taipei (TW)

(72) Inventors: Jian-Kuang Zhu, Kunshan (CN); Chun-Sheng Li, Kunshan (CN); Wei Zhong, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/331,086

(22) Filed: Jul. 14, 2014

(65) Prior Publication Data

US 2015/0017838 A1 Jan. 15, 2015

(30) Foreign Application Priority Data

Jul. 12, 2013 (CN) ..... 2013 2 0414866 U

(51) Int. Cl.
*H01R 13/6585* (2011.01)

(52) U.S. Cl.
CPC ..... *H01R 13/6585* (2013.01)

(58) Field of Classification Search
USPC ..... 439/625, 637, 660, 631, 563, 564, 567, 439/65, 74
See application file for complete search history.

(56) References Cited

U.S. PATENT DOCUMENTS

| | | | | |
|---|---|---|---|---|
| 6,254,435 | B1 * | 7/2001 | Cheong et al. | 439/637 |
| 6,695,622 | B2 * | 2/2004 | Korsunsky et al. | 439/65 |
| 6,755,671 | B1 * | 6/2004 | Fan et al. | 439/108 |
| 7,377,812 | B2 * | 5/2008 | Fukushima et al. | 439/607.41 |
| 7,892,006 | B2 * | 2/2011 | Guan et al. | 439/328 |
| 7,896,661 | B2 * | 3/2011 | Yao et al. | 439/83 |
| 7,950,965 | B2 * | 5/2011 | Cao et al. | 439/660 |
| 8,257,095 | B2 * | 9/2012 | Akai et al. | 439/74 |
| 8,979,562 | B2 * | 3/2015 | Crighton et al. | 439/160 |
| 9,048,581 | B2 * | 6/2015 | Briant | |
| 9,083,130 | B2 * | 7/2015 | Casher et al. | |
| 2008/0268704 | A1 * | 10/2008 | Hsu | 439/567 |
| 2015/0017838 | A1 * | 1/2015 | Zhu et al. | 439/625 |

FOREIGN PATENT DOCUMENTS

TW M316520 8/2007

* cited by examiner

*Primary Examiner* — Alexander Gilman
(74) *Attorney, Agent, or Firm* — Wei Te Chung; Ming Chieh Chang

(57) ABSTRACT

An electrical connector includes an housing and a plurality of first terminals. The housing includes a first side wall, a second side wall opposite to the first side wall and two end walls connecting with the first side wall with the second side wall. The first side wall defining a plurality of first terminal passageways arranged in an inner surface thereof. Every adjacent first terminal passageways being partitioned with spaced walls and the spaced walls and the inner surface of the first side wall being on a same plane, The first terminals accommodated in the first terminal passageways. Some of the spaced walls further integrally extend enhanced walls respectively to unitarily connect with the second side wall, thereby defining a base portion located at a rear portion of the housing and a mating cavity in front of the base portion.

14 Claims, 5 Drawing Sheets

ELECTRICAL CONNECTOR WITH ENHANCED STRUCTURE

BACKGROUND OF THE INVENTION

1. Field of the Invention

The present invention generally relates to an electrical connector, and more particularly to an electrical connector with simple production process and enhanced structure.

2. Description of Related Art

A patent issued No. M 316520 in Taiwan discloses an electrical connector. The electrical connector comprises a first insulative housing, a second insulative housing and a plurality of conductive terminals. The first insulative housing includes a base portion and a mating portion both extending along the first direction. The first insulative housing defines a plurality of terminal slots arranged at an interval from each other. The second insulative housing is inserted and retained in the first insulative housing. The second insulative housing defines a plurality of terminal grooves arranged at an interval from each other. The terminal grooves are defined correspondingly to the terminal slots, and the terminal grooves are running through the terminal slots along the second direction. The conductive terminals are accommodated respectively in the terminal slots and the terminal grooves. The technology described aforementioned needs two modules.

Although the technology can make the mating frame not easy to distortion and avoid the wall between the terminal slots/grooves rupture, but the processing of the production is complicated.

In view of the foregoing, an electrical connector with simple production process and enhanced structure would be desirable.

SUMMARY OF THE INVENTION

Accordingly, an object of the present invention is to provide an electrical connector having simple production process and enhanced structure.

In order to achieve the object set forth, an electrical connector defines a mating direction and a lengthwise direction perpendicular to the mating direction. The electrical connector includes an insulative housing and a plurality of first conductive terminals retained in the insulative housing. The insulative housing includes a first side wall, a second side wall opposite to the first side wall and two end walls connecting with the first side wall with the second side wall. The first side wall defining a plurality of first terminal passageways arranged in an inner surface thereof along the lengthwise direction and extending in the mating direction. Every adjacent first terminal passageways being partitioned with spaced walls and the spaced walls and the inner surface of the first side wall being on a same plane, The first conductive terminals accommodated in the first terminal passageways. Some of the spaced walls further integrally extend enhanced walls respectively to unitarily connect with the second side wall, thereby defining a base portion located at a rear portion of the insulative housing and a mating cavity in front of the base portion.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
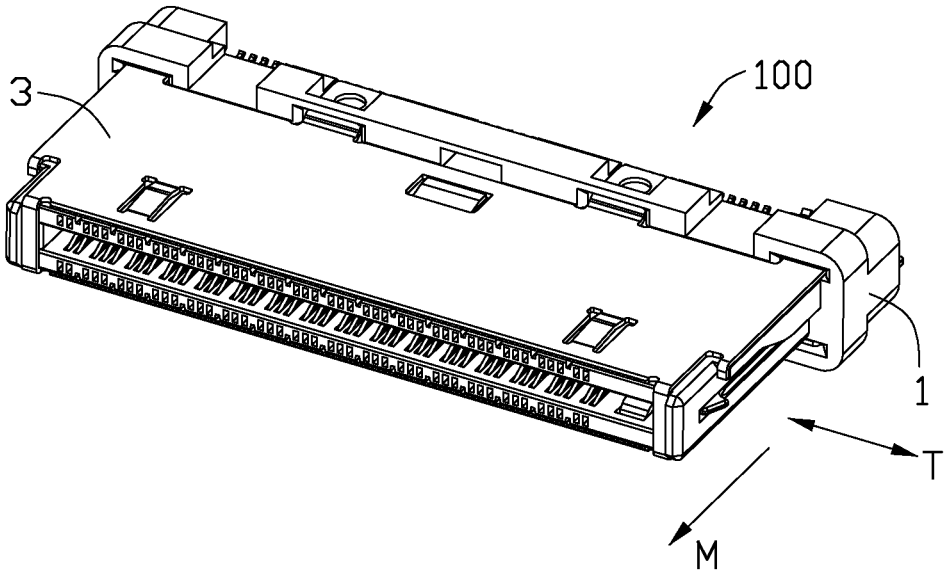
FIG. 1 is a perspective view of an electrical connector in accordance with the present invention.
Figure 2:
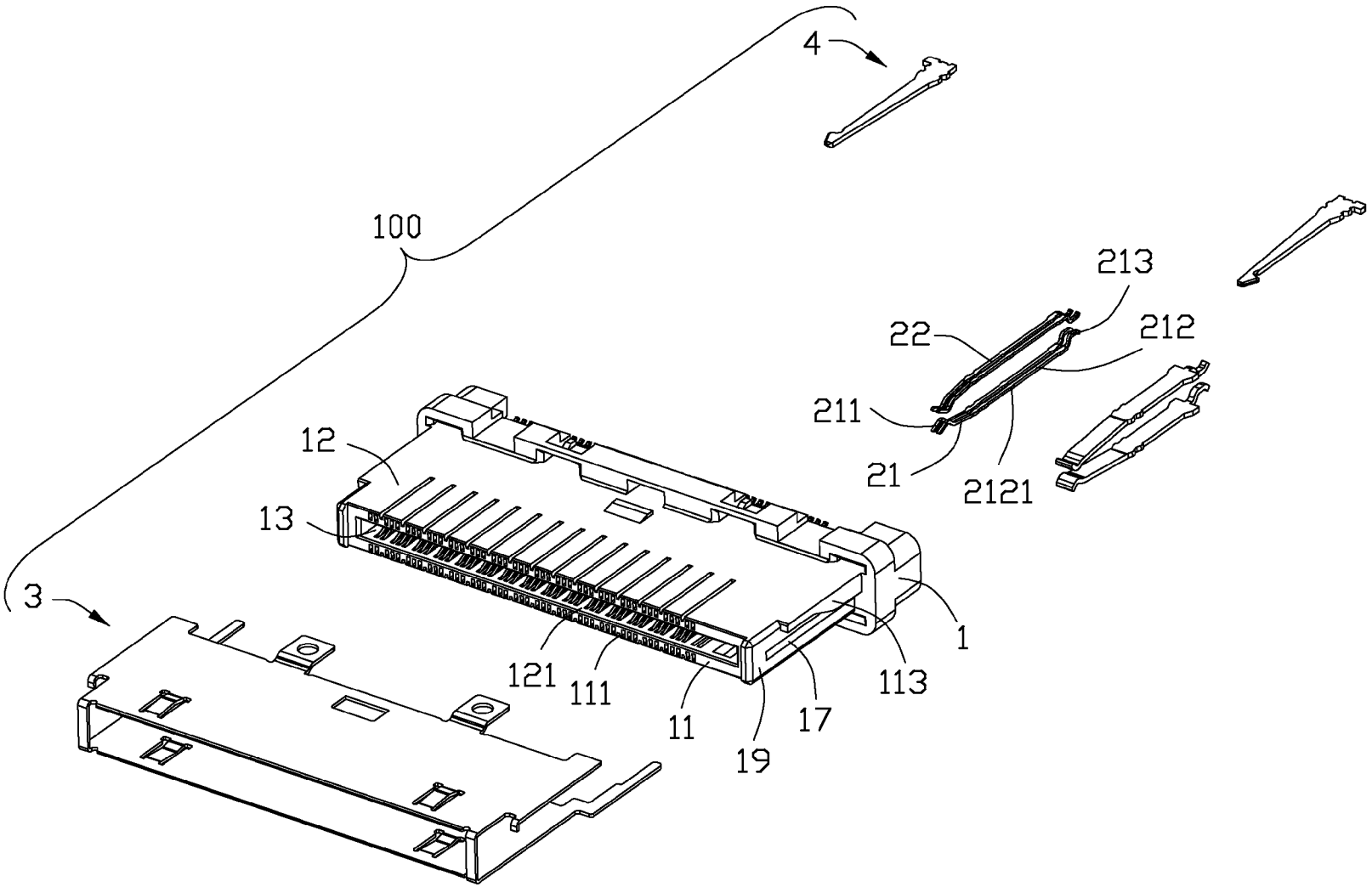
FIG. 2 is an exploded perspective view of the electrical connector shown in FIG. 1.

Referring to FIG. 1 and FIG. 2, The present invention provides an electrical connector 100 defining a mating direction M and a lengthwise direction T which is perpendicular to the mating direction. The electrical connector 100 comprises an insulative housing 1 and a plurality of first and second conductive terminals 21, 22. The insulative housing 1 defines a first side wall 11, a second side wall 12 which is opposite to the first side wall 11 and two end walls 19 between the first side wall 11 and the second side wall 12 and connect with them. Each of the two end walls is perpendicular to the first side wall 11 and the second side wall 12. The inner surface of the first wall 11 defines a plurality of first terminal passageways 111 arranged spaced apart from each other along the lengthwise direction. The first terminal passageways 111 extends along the mating direction. The inner surface of the second side wall 12 defines a plurality of second terminal passageways 121 arranged spaced apart from each other along the lengthwise direction. The second terminal passageways 121 extends along the mating direction. The first conductive terminals 21 are accommodated in the first terminal passageways 111. The second conductive terminals 22 are accommodated in the second terminal passageways 121.

The electrical connector 100 further includes a metal shell 3 surrounding the insulative housing 1 and a pair of locking members 4 retained on the two opposite side of the insulative housing and used for mating with the complementary connector. The two end portions 19 of the insulative housing 1 each defines a retaining slot 17 for accommodation of the locking members 4. The two end sides of the first side wall 11 each defines a protruding portion 113 extending outwardly in the longwise direction. The protruding portion 113 extending in the mating direction are spaced from or behind a front side of the first side wall 11. The upper surface of the protruding portion 113 and the upper surface of the first side wall 11 are in a same plane. The thickness of the protruding portions 113 in a direction perpendicular to the mating direction and the longwise direction is gradually decreasing in a back to front direction. The protruding portions 113 are used for preventing an insertion of a non-complementary connector.

Figure 3:
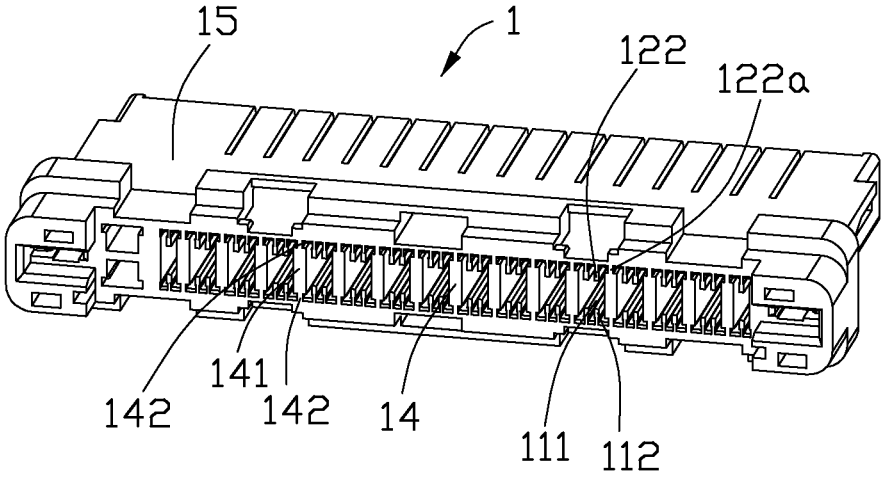
FIG. 3 is a perspective view of an insulative housing as shown in FIG. 2.
Figure 4:
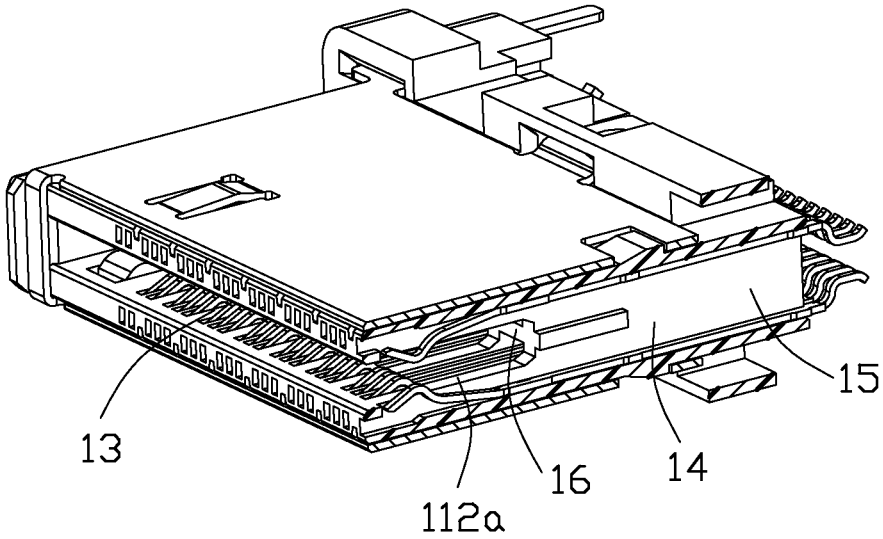
FIG. 4 is a perspective view of a left part of the electrical connector shown in FIG. 1.
Figure 5:
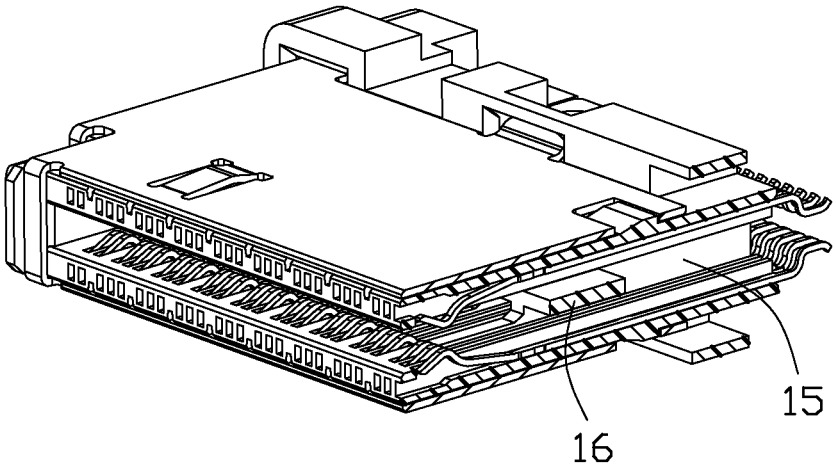
FIG. 5 is a perspective view of a left part of the electrical connector shown in FIG. 1.

The structure of the conductive terminals 21, 22 and the insulative housing 1 are introduced in detail hereinafter. Referring to FIG. 3 to FIG. 5, the first side wall 11 recessed with the first passageways 111 is separated from the second side wall 12 recessed with the second passageways 121. Every two of the first passageways or second passageways is partitioned with a spaced wall 112/122. The spaced walls 112 and the inner surface of the first side wall 11/second side wall 12 are on the same plane. Some of the spaced walls labeled with numeral 112*a* further form enhanced walls 14 as best shown in FIG. 4, extending upwards. The enhanced walls 14 connect with the spaced walls 112*a*, 122*a* of the first side wall 11 and the second side wall 12, thereby a base portion 15 of the housing 1 is formed and located in the rear portion of the housing. The insulative housing 1 defines a mating cavity 13 in front of the base portion 15. The front face of the base portion 15, the first and second side wall 11, 12, and the two end walls 19 commonly defines a mating cavity 13 thereamong. The mating cavity 13 runs through the front face of the insulative housing 1. In the best embodiment, the spaced walls 112*a* of the first side wall 11 and the spaced walls 122*a* of the second side wall 122 are aligned with each other. The enhanced wall 14 connect with corresponding spaced walls 112*a*, 122*a*. The enhanced walls 14 benefit to increase the strength of the insulative housing 1 so that the electrical connector 100 is not easy to be damaged in the process of the assembling and using.

Referring to FIG. 3 and FIG. 4, The enhanced walls 14 extend along the mating direction and are aligned with the base portion at rear faces thereof. Each of the enhanced walls 14 includes a flat portion 141 and two end portions 142. The flat portions 141 have a same thickness and wider than the end portions 142 along the lengthwise direction. The length of the flat portions 141 are longer than the length of the end portions 141 along a vertical direction which is perpendicular to the mating direction and the lengthwise direction. The length of the end portions 142 is shorter than the spaced walls 14 which are adjacent to them. In the lengthwise direction, all enhanced walls 14 are unitarily connected with a long rib 16. The rib 16 is spaced away from the spaced walls 112, 122. In the mating direction, the rib 16 and the enhanced walls 14 have a same front plane. The length of the base portion 15 is longer than the depth of the mating cavity 13.

Besides, each of the first conductive terminals 21 includes a retaining portion 212, a contacting portion 211 bending from one end of the retaining portion 212 and a connecting portion 213 bending from another end of the retaining portion 212. The retaining portion 212 defines a plurality of convex ribs 2121 retained in the first terminal passageways 111. The second conductive terminals 22 have the same structure with the first conductive terminals 21. A group of three first terminals 21 form a pair of differential signal terminals and a grounding terminal. Every group of terminals is disposed between every two adjacent enhanced walls 14. In the lengthwise direction, the spaced walls 112 between the two groups of terminals are wider than the spaced walls 112/122 between the first conductive terminals 21. In the best embodiment, the groups of terminals in the first and the second side walls are opposite to each other.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

We claim:

1. An electrical connector defining a mating direction and a lengthwise direction perpendicular to the mating direction, comprising:

an insulative housing having a first side wall, a second side wall opposite to the first side wall and two end walls connecting with the first side wall with the second side wall, the first side wall defining a plurality of first terminal passageways arranged in an inner surface thereof along the lengthwise direction and extending in the mating direction, every adjacent first terminal passageways being portioned with spaced walls and the spaced walls and the inner surface of the first side wall being on a same plane; and a plurality of first conductive terminals accommodated in the first terminal passageways;

wherein some of the spaced walls further integrally extend to form enhanced walls respectively to unitarily connect with the second side wall, thereby defining a base portion located at a rear portion of the insulative housing and a mating cavity in front of the base portion; wherein the enhanced walls are unitarily connected with each other by a rib in the lengthwise direction, the rib is spaced away from the spaced walls; wherein the rib and the enhanced walls are on a same plane facing to the mating direction.

2. The electrical connector as claimed in claim 1, wherein the enhanced walls extend along the mating direction and the enhanced walls and the base portion are on a same plane at a rear end.

3. The electrical connector as claimed in claim 2, wherein a group of three first terminals form a pair of differential signal terminals and a grounding terminals, and every group of terminals is disposed between every two adjacent enhanced walls, and in the lengthwise direction, the spaced walls between the two groups of terminals are wider than the spaced walls between the first conductive terminals.

4. The electrical connector as claimed in claim 1, wherein each of the enhanced walls includes a flat portion and two end portions, and the flat portions having a same thickness and wider than end portions along the lengthwise direction, and the length of each flat portions is longer than the length of each end portions in a vertical direction perpendicular to the mating direction and the lengthwise direction, and the end portions is shorter than the spaced walls in the vertical direction.

5. The electrical connector as claimed in claim 1, wherein the length of the base portion is longer than the depth of the mating cavity in the mating direction.

6. The electrical connector as claimed in claim 1, wherein the two end sides of the first side wall each defines a protruding portion extending outwardly in the longwise direction, and the protruding portions extending in the mating direction are spaced from or behind a front side of the first side wall, and the thickness of the protruding portions are gradually decreasing from the back to front direction perpendicular to the mating direction and the longwise direction, and the protruding portions and the first side wall are on a same plane, and the upper surface of the protruding portions and the upper surface of the first side wall are in a same plane, and the thickness of the protruding portions in a direction perpendicular to the mating direction and the longwise direction is gradually decreasing in a back to front direction.

7. The electrical connector as claimed in claim 1, wherein the electrical connector further comprises a plurality of second conductive terminals, and the inner surface of the second side wall defining a plurality of second terminal passageways arranged spaced apart from each other along the lengthwise direction, every two of the second terminal passageways partitioned with a spaced wall, and the second conductive terminals extending along the mating direction accommodated in the second terminal passageways, and the spaced walls of the second side wall and the inner surface of the second side wall are on the same plane, the enhanced walls connecting with the corresponding spaced walls of the first side wall.

8. The electrical connector as claimed in claim 7, wherein some of the spaced walls of the first side wall and some of the spaced walls of the second side wall are correspondingly aligned with each other, and the enhanced walls each unitarily connecting with the corresponding spaced walls.

9. An electrical connector comprising:

an insulative housing defining a receiving cavity between opposite first and second external side walls;

a plurality of passages formed in the housing and between said opposite first and second external side walls along a longitudinal direction, every adjacent two passages being separated by a dividing enhancing wall unitarily formed between said opposite first and second external side walls and extending in a transverse direction perpendicular to said longitudinal direction;

in each of said passages, a rib structure unitarily formed between the corresponding two opposite dividing enhancing walls, extending in the longitudinal direction at a middle position in the transverse direction, and located right behind the receiving cavity, first and second rows of spaced walls formed on corresponding inner surfaces of the opposite first and second external side walls, respectively; and said first and second rows of spaced walls being spaced from each other in the transverse direction; wherein in each of said passages, a first row of terminals are received and retainably regulated by the first row of spaced walls and the corresponding dividing enhancing walls, and a second row of terminals are received and retainably regulated by the second row of spaced walls and the corresponding dividing enhancing walls.

10. The electrical connector as claimed in claim 9, wherein in each of said passages, there are three first row of terminals regulated by two first row of spaced walls, and there are three second row of terminals regulated by two second row of spaced walls.

11. The electrical connector as claimed in claim 9, wherein in each of said passages, the rib structure extends rearwardly while terminated in a half way before reaching a rear end of the housing.

12. The electrical connector as claimed in claim 9, wherein the first row of spaced walls and the second row of spaced walls extend from a front face of the housing and terminals at a rear face of the housing.

13. The electrical connector as claimed in claim 9, wherein in each of said passages, the first row of spaced walls and the second row of spaced walls are spaced from the corresponding rib structure in the transverse direction.

14. An electrical connector defining a mating direction and a lengthwise direction perpendicular to the mating direction, comprising:

an insulative housing having a first side wall, a second side wall opposite to the first side wall and two end walls connecting with the first side wall with the second side wall, the first side wall defining a plurality of first terminal passageways arranged in an inner surface thereof along the lengthwise direction and extending in the mating direction, every adjacent first terminal passageways being portioned with spaced walls and the spaced walls and the inner surface of the first side wall being on a same plane; and a plurality of first conductive terminals accommodated in the first terminal passageways;

wherein some of the spaced walls further integrally extend to form enhanced walls respectively to unitarily connect with the second side wall, thereby defining a base portion located at a rear portion of the insulative housing and a mating cavity in front of the base portion; wherein each of the enhanced walls includes a flat portion and two end portions, and the flat portions having a same thickness and wider than end portions along the lengthwise direction, and the length of each flat portions is longer than the length of each end portions in a vertical direction perpendicular to the mating direction and the lengthwise direction, and the end portions is shorter than the spaced walls in the vertical direction.

* * * * *